US009619953B2

(12) United States Patent
Ranchod

(10) Patent No.: US 9,619,953 B2
(45) Date of Patent: Apr. 11, 2017

(54) KEYLESS LOCK AND METHOD OF USE

(71) Applicant: Dog & Bone Backbone Pty Ltd, Brisbane (AU)

(72) Inventor: Lee Ranchod, Willawong (AU)

(73) Assignee: D & B Backbone PTY LTD, Brisbane, Queensland (AU)

( * ) Notice: Subject to any disclaimer, the term of this patent is extended or adjusted under 35 U.S.C. 154(b) by 34 days.

(21) Appl. No.: 15/017,781

(22) Filed: Feb. 8, 2016

(65) Prior Publication Data

US 2016/0292943 A1 Oct. 6, 2016

Related U.S. Application Data

(63) Continuation-in-part of application No. 14/958,300, filed on Dec. 3, 2015, which is a continuation-in-part of application No. 14/676,073, filed on Apr. 1, 2015, now abandoned.

(51) Int. Cl.

| | |
|---|---|
| ***G05B 19/00*** | (2006.01) |
| ***G07C 9/00*** | (2006.01) |
| ***E05B 37/00*** | (2006.01) |
| ***E05B 47/00*** | (2006.01) |

(52) U.S. Cl.

CPC ..... *G07C 9/00182* (2013.01); *E05B 37/0068* (2013.01); *E05B 47/0001* (2013.01); *E05B 2047/0072* (2013.01); *E05B 2047/0094* (2013.01); *G07C 2009/00769* (2013.01)

(58) Field of Classification Search

CPC ..... G07C 9/00182; G07C 2009/00769; E05B 37/0068; E05B 47/0001; E05B 2047/0072; E05B 2047/0094

USPC ..... 340/5.64, 5.61, 5.62, 5.25, 636.1, 572.9, 340/10.5, 5.73; 70/20, 277, 278.1, 15, 70/366, 276, 26, 56

See application file for complete search history.

(56) References Cited

U.S. PATENT DOCUMENTS

| | | | | |
|---|---|---|---|---|
| 2015/0233148 | A1* | 8/2015 | Yu | E05B 67/06 70/20 |
| 2015/0267438 | A1* | 9/2015 | Martinez | E05B 47/0001 70/278.1 |
| 2015/0292244 | A1* | 10/2015 | Beatty | E05B 47/0012 70/20 |

* cited by examiner

*Primary Examiner* — Dhaval Patel
(74) *Attorney, Agent, or Firm* — Shifrin Patent Law; Dan Shifrin

(57) ABSTRACT

A method of operating a keyless padlock is provided, comprising: establishing communication with the padlock; requesting the padlock serial number from the padlock; receiving the padlock serial number form the padlock; establishing communication with a server having the padlock serial number and the initial password stored in a database; transmitting the padlock serial number to the server with a request to own the padlock; receiving the initial password and a new password from the server after the server has validated the request; transmitting the initial password to the padlock; transmitting the new password to the padlock after the padlock has validated the initial password; receiving confirmation from the padlock that the padlock has stored the new password in the memory of the padlock; and transmitting the confirmation to the server, whereupon the server updates the database to recognize the user as the owner of the padlock.

27 Claims, 13 Drawing Sheets

KEYLESS LOCK AND METHOD OF USE

CROSS-REFERENCE TO RELATED APPLICATION

This application is a continuation-in-part of commonly-owned and co-pending U.S. patent application Ser. No. 14/958,300, filed Dec. 3, 2015, entitled "Keyless Padlock, System and Method of Use," and of commonly-owned and co-pending U.S. patent application Ser. No. 14/676,073, filed Apr. 1, 2015, entitled "Keyless Padlock, System and Method of Use," which is a continuation of commonly-owned U.S. Pat. No. 9,109,379, issued Aug. 18, 2015, entitled "Keyless Padlock, System and Method of Use," both of which are hereby incorporated by reference in their entireties.

TECHNICAL FIELD

The present invention relates to locks, and in particular to locks that are operable using a signal from a personal computing device.

BACKGROUND ART

Padlocks are well known in the marketplace and are widely used to lock doors, gates and the like. Padlocks can be seen as are portable locks which can be removed from the door/gate or the like or other application when the lock is not required. This distinguishes padlocks from other forms of locks such as those that are retained in doors, windows, gates etc., including deadbolts.

Typical padlocks are formed with a strong padlock body (typically generally of brass or steel), and the padlock body usually contains a main passageway opening. A key barrel cylinder (usually in the form of a key barrel) can be fitted in the main passageway opening so that a key can be used to open the padlock (again, usually by inserting and turning a key).

Padlocks also typically have a shackle. The shackle typically generally comprises a rigid U-shaped metal member which can be formed from steel or brass. The parallel portions of the U-shaped shackle form two spaced apart parallel legs and one leg is generally longer than the other. In conventional padlocks, the longer leg passes through an opening in the top of the padlock body and is secured therein in such a manner that the leg cannot be pulled out. When the padlock is open, the secured long leg is often able to pivot about its axis so that the short leg (i.e. the other leg of the U-shaped shackle) rotates in an arc about the long leg. The longer leg of the shackle is also generally able to slide axially inwards and outwards within the opening in the body (although in conventional padlocks the shackle cannot slide all the way out of the body).

Typically, padlocks are locked by moving the shackle downwardly so that the short leg is inserted into a blind bore in the top of the padlock body. The short leg is then lockable therein to lock the padlock. The padlock can be unlocked by operating the key cylinder, and a spring is typically provided to bias the shackle to the open condition (i.e. where the short leg is retracted upwardly out of the body and can rotate about the long leg as described). Where the cylinder is a key barrel, a key can be inserted into the key cylinder barrel and turned to thereby release the shackle allowing the shackle to move upwardly into the open condition under the bias of the spring.

It will be clearly understood that, if a publication is referred to herein, this reference does not constitute an admission that the publication forms part of the common general knowledge in the art in Australia or in any other country.

SUMMARY OF INVENTION

The present invention is directed to a keyless lock, system and method of use, which may at least partially overcome at least one of the abovementioned disadvantages or provide the consumer with a useful or commercial choice.

More specifically, in one embodiment of the present invention, a keyless padlock system is provided, comprising: a keyless padlock comprising: a padlock body; a shackle; a locking mechanism located in the body and associated with the shackle to lock the shackle to the body in a locked condition and to release at least a part of the shackle in an unlocked condition, the locking mechanism comprising: a control assembly, comprising: a memory in which a padlock serial number and an initial password are stored; and a communication module; and an actuator controlled by the control assembly to move the shackle into the locked condition and into the unlocked condition in response to respective signals from the control assembly; and an application loadable on a personal computing device of a user, the personal computing device having a memory, a processor, and a communication module, the application comprising instructions executable by the processor to: establish communication with the padlock; request the padlock serial number from the padlock; receive the padlock serial number form the padlock; establish communication with a server having the padlock serial number and the initial password stored in a database; transmit the padlock serial number to the server with a request to own the padlock; receive the initial password and a new password from the server after the server has validated the request; transmit the initial password to the padlock; transmit the new password to the padlock after the padlock has validated the initial password; receive confirmation from the padlock that the padlock has stored the new password in the memory of the padlock; and transmit the confirmation to the server, whereupon the server updates the database to recognize the user as the owner of the padlock.

In another embodiment of the present invention, a method of operating a keyless padlock is provided, comprising: establishing a user of a personal electronic device as the authorized owner of the padlock by: establishing communication with the padlock; requesting the padlock serial number from the padlock; receiving the padlock serial number form the padlock; establishing communication with a server having the padlock serial number and the initial password stored in a database; transmitting the padlock serial number to the server with a request to own the padlock; receiving the initial password and a new password from the server after the server has validated the request; transmitting the initial password to the padlock; transmitting the new password to the padlock after the padlock has validated the initial password; receiving confirmation from the padlock that the padlock has stored the new password in the memory of the padlock; and transmitting the confirmation to the server, whereupon the server updates the database to recognize the user as the owner of the padlock; and allowing the authorized owner of the padlock to operate the padlock by: reestablishing the connection with the padlock; and in response to an input from the authorized owner, transmitting the new password to the padlock with a request move the shackle to one of a locked condition and an unlocked condition.

In still another embodiment of the present invention, a non-transitory processor-readable medium comprising program instructions is provided for operating a keyless padlock, wherein the program instructions are executable by a processor on a personal computing device to: establish communication with the padlock; request the padlock serial number from the padlock; receive the padlock serial number form the padlock; establish communication with a server having the padlock serial number and the initial password stored in a database; transmit the padlock serial number to the server with a request to own the padlock; receive the initial password and a new password from the server after the server has validated the request; transmit the initial password to the padlock; transmit the new password to the padlock after the padlock has validated the initial password; receive confirmation from the padlock that the padlock has stored the new password in the memory of the padlock; and transmit the confirmation to the server, whereupon the server updates the database to recognize the user as the owner of the padlock.

A keyless padlock, comprising: a padlock body; a shackle; and a locking mechanism located in the body and associated with the shackle to lock the shackle to the body in a locked condition and to release at least a part of the shackle in an unlocked condition, the locking mechanism comprising: a control assembly having a Bluetooth communication module, the Bluetooth communication module configured to: receive and accept a Bluetooth pairing request from an smartphone; and receive commands from the smartphone to operate the padlock; and an actuator controlled by the control assembly to move the shackle into the locked condition and into the unlocked condition in response to the received commands from the smartphone.

It can be seen that the keyless lock system of the present invention provides distinctive advantages over the conventional lock operation which requires a physical key and that the components and operation of the keyless lock and the system of operation allows a user to use the lock themselves securely or to authorise others to use the lock on their behalf. Although much of the description and figures refer to keyless padlocks, the present invention may also be incorporated in any other type of lock.

Any of the features described herein can be combined in any combination with any one or more of the other features described herein within the scope of the invention.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF THE PREFERRED EMBODIMENT

Figure 1:
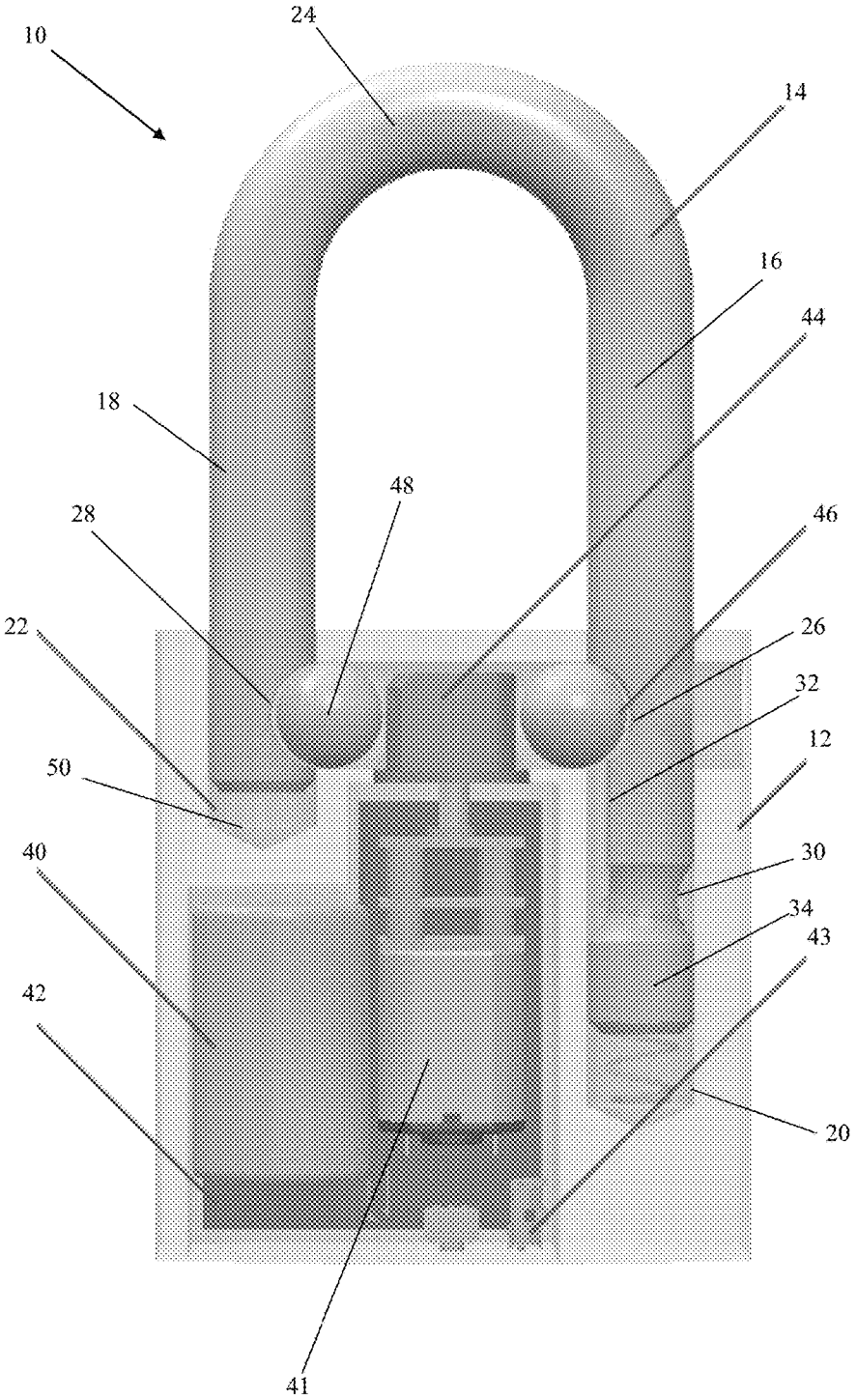
FIG. 1 is a schematic view of a keyless padlock according to an embodiment of the present invention with the body transparent for clarity purposes.
Figure 2:
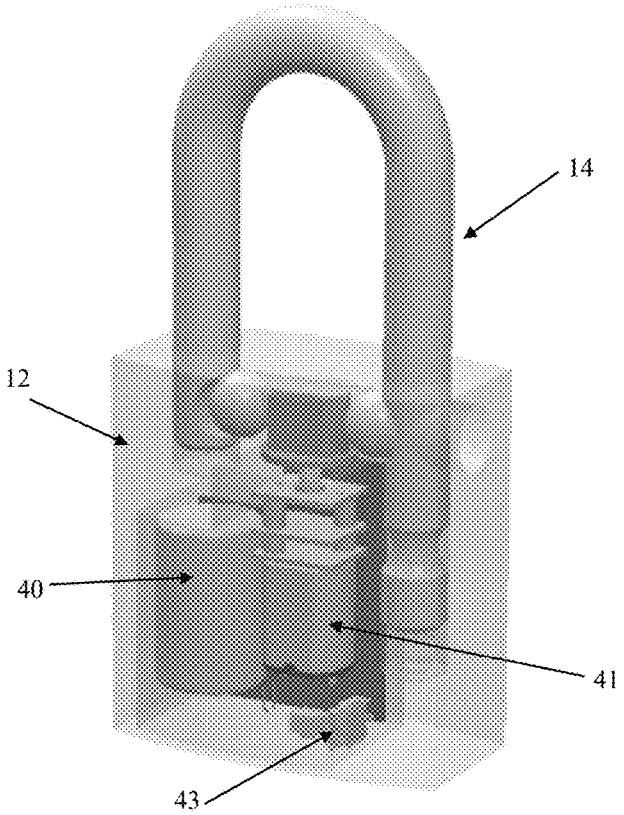
FIG. 2 is an axonometric view of the keyless padlock illustrated in FIG. 1.
Figure 3:
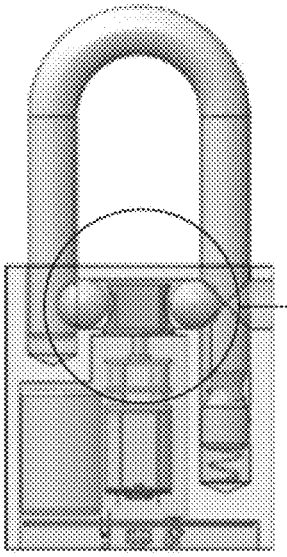
FIG. 3 is a schematic view front view of the keyless padlock illustrated in FIG. 1 in the locked condition.
Figure 3A:
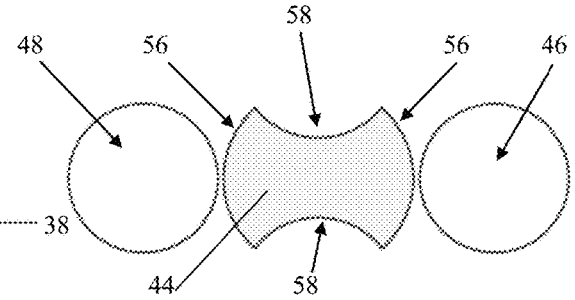
FIG. 3A is a schematic illustration from the top showing relative positions of the camming member and locking balls of the keyless padlock illustrated in FIG. 3.
Figure 4:
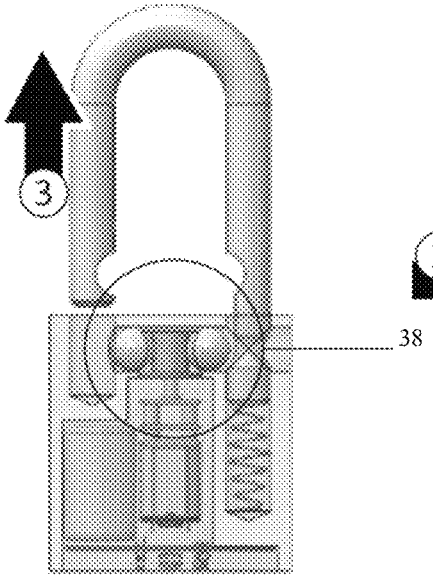
FIG. 4 is a schematic view front view of the keyless padlock illustrated in FIG. 1 in the unlocked condition.
Figure 4A:
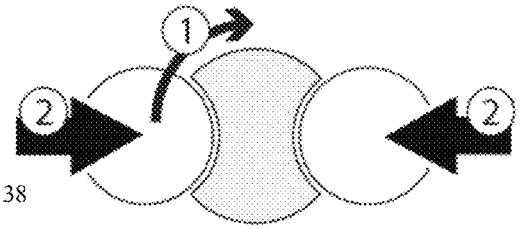
FIG. 4A is a schematic illustration from the top showing relative positions of the camming member and locking balls of the keyless padlock illustrated in FIG. 4.
Figure 5:
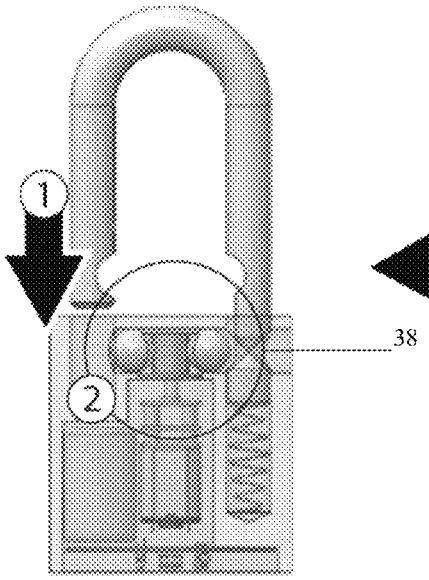
FIG. 5 is a schematic view front view of the keyless padlock illustrated in FIG. 1 showing the movement from the unlocked condition to the locked condition.
Figure 5A:
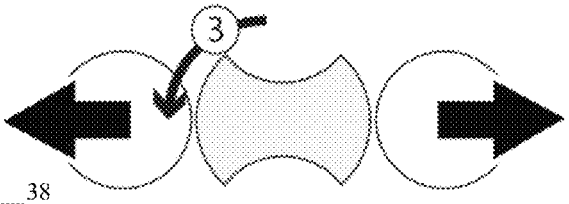
FIG. 5A is a schematic illustration from the top showing relative positions of the camming member and locking balls of the keyless padlock illustrated in FIG. 5.

According to embodiments of the present invention, a keyless padlock system and methods for it use are provided. With reference to FIG. 1, there is shown a keyless padlock 10 in accordance with an embodiment of the present invention comprising a padlock body 12 and a shackle 14. Shackle 14 comprises a long leg 16 and short leg 18, and body 12 comprises a long leg bore 20 and a short leg bore 22. Long leg 16 is adapted to be insertable into long leg bore 20, and short leg 18 is adapted to be insertable into short leg bore 22.

Referring now to shackle 14 it can be seen that, in the orientation in FIG. 1, the general shape of shackle 14 is similar to that of an inverted "U". Therefore, the two parallel portions of the U form long leg 16 and short leg 18, and the upper end of the respective legs are integrally connected by an arcuate member 24 corresponding to the curved portion of the U. More specifically, in the embodiment shown, long leg 16 and short leg 18 are both substantially cylindrical (i.e. having a substantially circular cross-section) of equal diameter, and long leg 16 is substantially longer than short leg 18 so that the lower end of long leg 16 extends substantially below the lower end of short leg 18. Because the respective legs are substantially cylindrical, therefore arcuate member 24 (which is integrally formed with the legs) has a substantially semi-toroidal shape connecting the tops of the two legs and having approximately the same cross-section as the legs.

Both long leg 16 and short leg 18 have a locking notch 26, 28 therein. Notches 26, 28 comprise substantially semi-tubular cutouts in the inner side of the respective legs, the cutouts being oriented such that the longitudinal axis of each semi-tubular cutout is substantially perpendicular to the longitudinal axis of the respective legs and offset inwardly thereof. Notch 28 in short leg 18 is located towards the lower end of short leg 18, and notch 26 in long leg 16 is located approximately midway down the length of long leg 16 such that both the notches are located at substantially the same level, thus effectively making each notch a mirror image of the other.

Long leg 16 further comprises a groove 30, a retaining flat aperture in the form of inner flat 32, and a bottom surface 34. Groove 30, located towards the lower end of long leg 16, has a substantially semicircular cross-section and extends all the way around long leg 16. Thus, groove 30 forms a substantially circumferential cutout around the lower end of long leg 16. Importantly, the maximum depth to which groove 30 is recessed into long leg 16 is substantially less than the maximum depth to which notches 26, 28 are indented into the respective leg members.

Inner flat 32 comprises a substantially flat surface extending down the inner side of long leg 16 from the lower edge of notch 26 to groove 30. Inner flat 32 is also slightly indented into long leg 16 and it therefore forms a slightly recessed flat surface. The depth to which inner flat 32 is recessed into long leg 16 is approximately the same as the depth of groove 30. Therefore, inner flat 32 effectively blends smoothly into groove 30 at the point where the two intersect, and there is no distinct ridge, edge or other delineation between the two.

Referring again to FIG. 1, it can be seen that padlock assembly 10 has an internal locking mechanism 38 for locking and unlocking the padlock. Locking mechanism 38 comprises battery 40, at least one actuator 41, a printed circuit board that includes at least one control assembly 42, micro USB port 43, camming member 44, and locking balls 46, 48. A charger may be plugged in to the micro USB port 43 to recharge the battery 40.

It can be seen that camming member 44 comprises a pair of convex camming surfaces 56 located on opposite sides thereof, and a pair of concave cavities 58 also located on opposed sides thereof and interposed between the camming surfaces 56. The locking balls 46, 48 are positioned one on either side of camming member 44. Camming member 44 is pivotable between a locked position and an unlocked position. FIG. 1 shows camming member 44 in the locked position wherein the camming surfaces 56 contact with the balls 46, 48, thereby pushing ball 46 into engagement with notch 26 in long leg 16 and pushing ball 48 into engagement with notch 28 in short leg 18. It will be clearly understood that the diameter of each of the balls 46, 48 is such that balls 46, 48 fit snugly and sufficiently deeply into notches 26 and 28 so as to prevent vertical movement of the respective legs within the body. Thus, when camming member 44 is in the locked position and both legs of the shackle are inserted into their respective bores in body 12, the legs are retained within body 12 by engagement of the balls 46, 48, and the padlock is locked.

Camming member 44 can be pivoted from the locked position into the unlocked position by rotating camming member 44 approximately 90° (counterclockwise when viewed from above). This is done by operating actuator 41, as explained in greater detail below.

When camming member 44 is pivoted into the unlocked position, locking balls 46, 48 are no longer in engagement with camming surfaces 56 and therefore they are not being pushed into engagement with the notches 26 and 28 in the legs. Instead, locking balls 46, 48 are allowed to retreat into the cavities 58 in camming member 44. It will be understood that cavities 58 are sufficiently deep, and that locking balls 46, 48 can retreat sufficiently far into cavities 58, such that the bottom edges of the respective notches 26 and 28 can move upwardly past balls 46, 48. Hence, rotation of camming member 44 into the unlocked position allows legs 16 and 18 of the shackle to move upwardly within the body 12. In particular, it allows short leg 18 to be retracted entirely out of short leg bore 22, thus opening the padlock.

However, it will also be understood that, even when balls 46, 48 are retracted into recesses 58, they are not retracted entirely within the cavities. Therefore, balls 46, 48 extend outwardly to some extent even when they are retracted into cavities 58, albeit to a lesser extent than they do when they are pushed into engagement with notches 26, 28 by camming surfaces 56. This is particularly important in relation to ball 46. It will be recalled that inner flat 32 (which is recessed slightly into long leg 16 but less deeply than notch 26) extends down the inside of long leg 16 between the lower edge of notch 26 and groove 30. Therefore, even though ball 46 retracts out of notch 26 when the balls are retracted into cavities 58, nevertheless ball 26 still extends outwardly sufficiently to engage with inner flat 32. It will also be recalled that the lower edge of groove 30 forms a lip 37. Therefore, even when ball 46 is retracted into cavities 58 and the short leg 18 is retracted out of short leg bore 22 so that the padlock is open, nevertheless the engagement of ball 46 with inner flat 32 and lip 37 prevents long leg 16 from being retracted out of long leg bore 20.

The circumferential shape of groove 30 allows long leg 16 to rotate within long leg bore 20 (i.e. shackle 14 can be rotated about long leg 16) when the padlock is open. Groove 30 effectively creates track within which ball 46 can roll as shackle 14 rotates.

The locked and unlocked positions of the camming member 44 and locking balls 46 and 48 is illustrated in more detail in FIGS. 3 to 5A.

Figure 10:
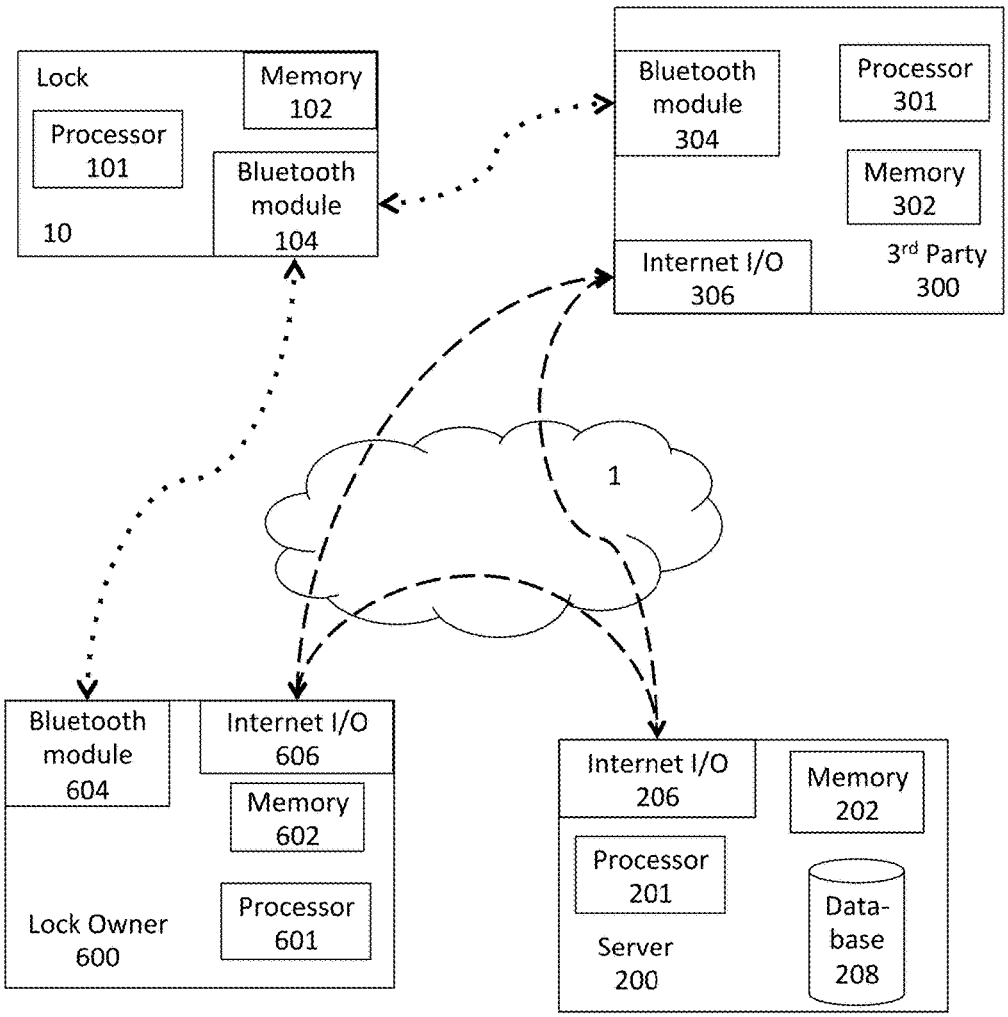
FIG. 10 is a block diagram of an embodiment of a keyless padlock system of the present invention.

The actuator 41 provided in the body 12 of the keyless padlock 10 is energised as required by the battery 40 provided in the body 12 and controlled by the control assembly 42. As illustrated, the actuator 41 is typically approximately centrally located within the body 12 of the keyless padlock 10 in a position similar to that held by the key cylinder in a conventional padlock. As illustrated in FIG. 10, the control assembly 42 of the padlock 10 includes at least a processor 101, a memory 102, and a Bluetooth® module 104 (incorporating a receiver and a transmitter). The control assembly 42 provides signals to the actuator 41 to move the shackle 14 into locked and unlocked conditions.

In one embodiment, a switch 50 is provided in the body 12 associated with the short arm 18 of the shackle 14 such that when the short arm 18 of the shackle 14 is aligned with the short arm bore 22 in the body 12 and depressed by the user in order to lock the padlock, the switch 50 is typically activated which in turn is used to signal the actuator 41 to rotate the camming member 44 to lock the shackle 14.

Thus, the provision of a unique identifying code means that the keyless padlock 10 does not require a physical key in order to open the padlock 10.

Figure 6:
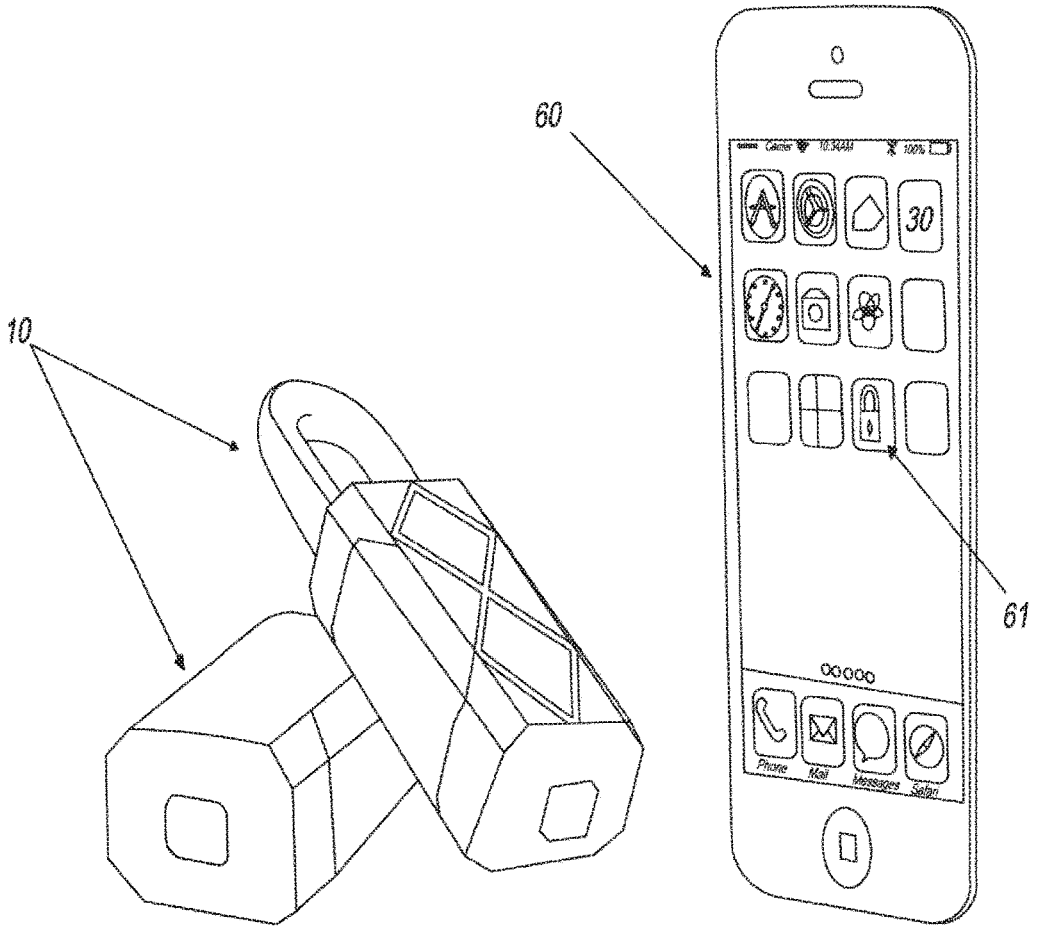
FIG. 6 is a schematic view of the keyless padlock and a smartphone operating the software application according to an embodiment of the system of the present invention.

The system of the present invention includes two component parts, namely the keyless padlock 10 and a software application (or "app") which is operable on a personal computing device such as a smartphone 60, as illustrated in FIGS. 6 and 10, and is carried by a person and is therefore easily accessible to the user. The smartphone 60 includes at least a processor 601 configured to execute the software application, comprising programmed instructions stored in an associated memory 602, and a display upon which an interface can be generated and displayed allowing user interaction with the software application. The smartphone 60 also has access to a number of communications pathways such that the unique identifying code can be transmitted via any one or more of a variety of communications pathways. These communications pathways typically include Wi-Fi, Bluetooth 604, as well as telecommunications networks and data links through an interface 606 to the internet 1 (FIG. 10). It will be appreciated that the padlock 10 may be operated by devices other than smartphones such as, for example, tablet computers. The smartphones referenced and illustrated herein are merely representative of all electronic devices that may be used with the padlock 10.

Normally the software application operates according to instructions stored in the memory 602 of the smartphone 60 put into effect using the processor 601 and controlled by interaction with the user via the interface generated and displayed on the display and/or other input apparatus provided with the smartphone 60 in order to retrieve and transmit the unique identifying code to the padlock 10 as required. In the simplest form, the unique identifying code is stored on the smartphone 60 (typically in the memory 602 associated with the software application) which has been paired with the keyless padlock 10.

In the embodiment illustrated in the Figures, communication between the padlock 10 and any smartphone uses Bluetooth modules in the respective devices (dotted lines in FIG. 10); communication between the server and any smartphone uses internet interfaces in the respective devices (dashed lines in FIG. 10); and, direct communication between smartphones also uses internet interfaces in the respective devices (dashed lines in FIG. 10). However, other forms of communication may be used.

Figure 11A:
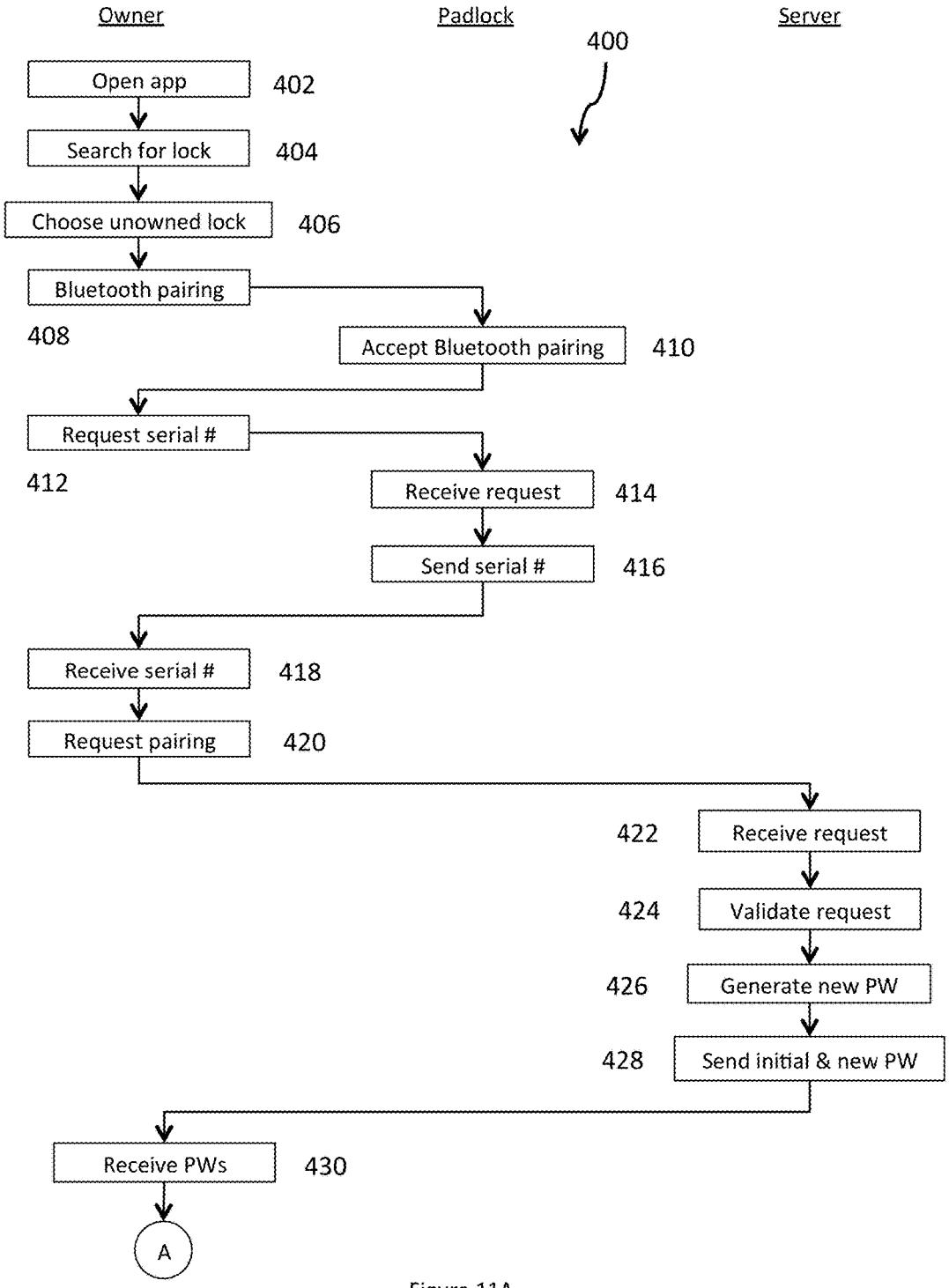
FIG. 11A is a flowchart of a method of initializing the keyless padlock of FIG. 10.
Figure 11B:
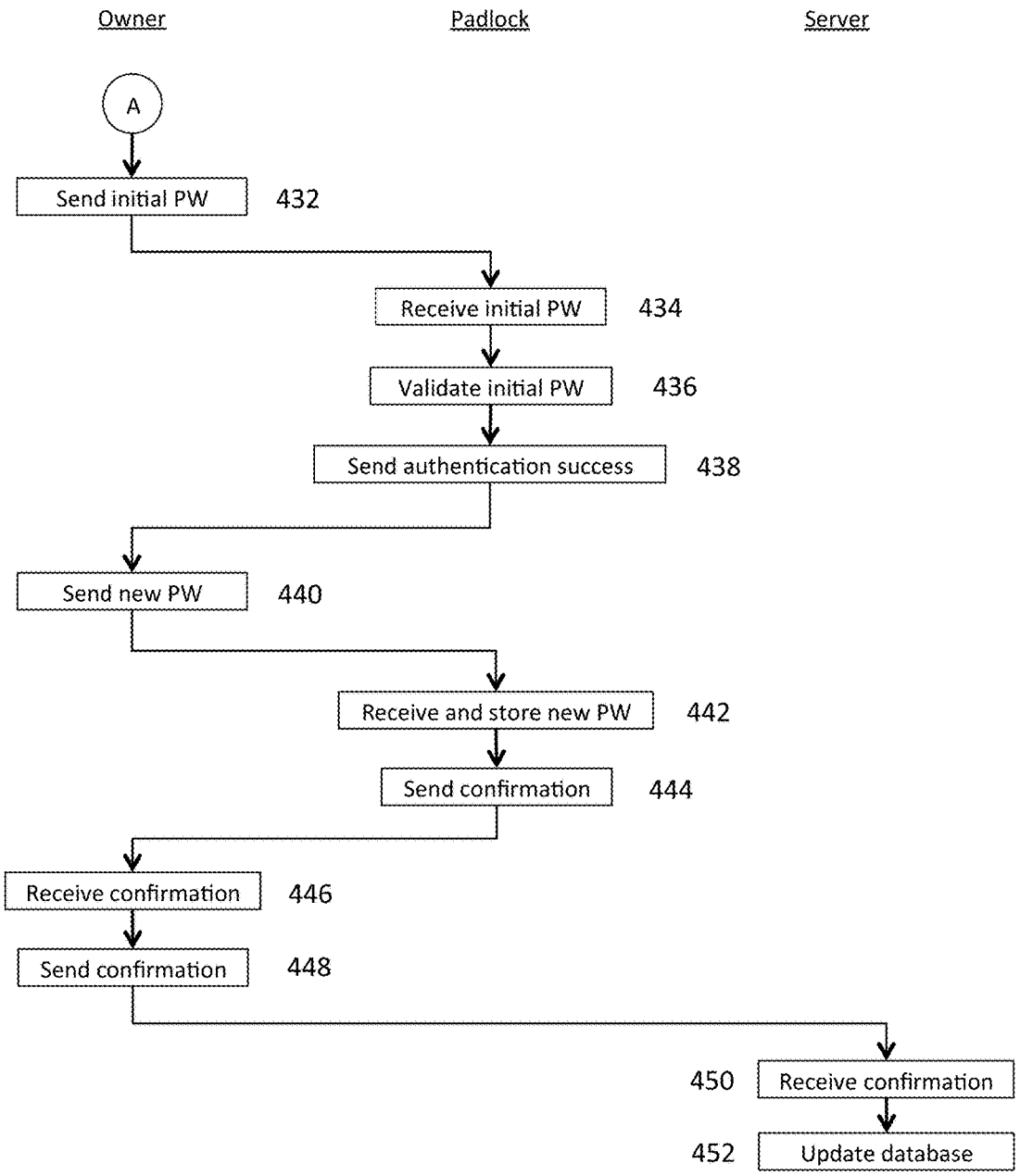
FIG. 11B is a continuation of the flowchart of FIG. 11A.

More specifically, FIGS. 11A and 11B provide a flowchart of the process 400 for initializing the keyless padlock 10. Although the lock 10 is programmed with an initial password, that password is not known to the prospective owner and the prospective owner cannot operate the lock 10. The prospective owner of the padlock 10 downloads and opens the application on his or her smartphone 60 (step 402). The Bluetooth module 604 will search for any nearby padlocks (step 404). When the app indicates the presence of an unowned Bluetooth-enabled lock, such as the padlock 10, the prospective owner selects the lock (step 406) to begin Bluetooth pairing with the lock 10 (step 408). After the lock 10 accepts the pairing (step 410), the app requests the serial number from the lock 10 (step 412). The lock 10 receives the request (step 414) and sends the serial number to the smartphone 60 (step 416). Upon receipt of the serial number (step 418), the smartphone 60 sends an operational pairing request, including the serial number of the lock 10, to a server 200 (FIG. 10) through an internet connection to become the authorized owner of the lock 10 (step 420). As illustrated in FIG. 10, the server 200 includes at least a processor 201, a memory 202 configured to store programmed instructions executed by the processor 201, an internet access I/O 206, and a database 208 in which padlock and owner account information is stored.

Continuing the initialization process, when the server 200 receives the operational pairing request (step 422), it accesses the database 208 to ensure that the serial number sent by the smartphone 60 is valid and that the lock 10 is unowned (step 424). If the serial number is valid and the lock 10 is unowned, the server 200 generates a new password (step 426) and sends both the initial password and the new password to the owner (step 428), who receives both passwords through the app on the smartphone 60 (step 430). To complete the operational pairing with the lock 10, the owner instructs the app to send the initial password to the lock 10 using the previously established Bluetooth connection (step 432). After receiving the initial password, (step 434), the processor 101 in the lock 10 determines if the initial password matches the password stored in the memory 102 of the lock 10 (step 436). If so, the lock 10 sends a message to the smartphone 60 app indicating that the authentication of the initial password was successful (step 438), whereupon the app sends the new password to the lock 10 (step 440). The new password may be automatically transmitted by the app upon receipt of the authentication success message or may be sent after the owner specifically requests that the new password be sent, such as by selecting a "send new password" option from the smartphone 60 display.

The lock 10 receives the new password (step 442) and stores it in its memory 102, superseding the initial password, and sends a confirmation back to the app (step 444). To complete the initialization process, after receiving the confirmation from the lock 10 (step 446), the app sends its confirmation to the server 200 through the internet (step 448). The server 200 receives the confirmation (step 450) and updates the database 208 (step 450) to associate the new owner of the lock 10 with at least the new password and the serial number of the lock 10. It will be appreciated that the database 208 may store other information about the owner and the lock 10.

To operate the lock 10, the owner opens the app on the smartphone 60 and establishes a Bluetooth connection with the lock 10 by being in relatively close proximity to the lock 10. The lock 10 will appear on the display with its current locked/unlocked status. The owner may then select the lock or unlock command, depending on the status of the lock 10. The app then sends the password to the lock 10 using the Bluetooth connection and the control assembly 42, upon validating the received password with the password stored in its memory 102, activates the actuator 41 to move the shackle 14 into the locked or unlocked condition. If the password is not correct, the lock 10 will not operate.

Figure 7:
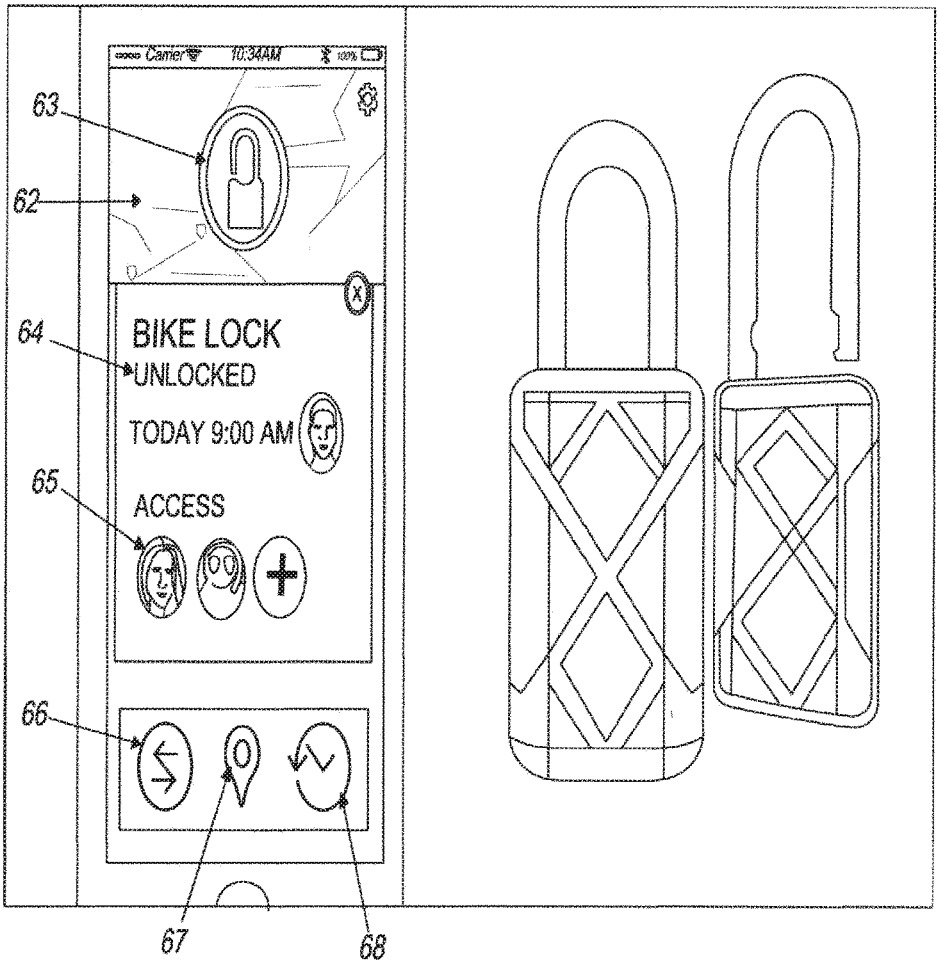
FIG. 7 is a more detailed view of an interface generated on the smartphone of an owner by the software application according to an embodiment of the present invention.

As illustrated in FIG. 7, the software application may also provide an interface that allows the location of the keyless padlock 10 which has been paired with the particular smartphone 60 to be displayed on a map 61. The interface may provide other information including status of the padlock 10 and the embodiment illustrated in FIG. 7 does so graphically via icon 63 and also in text 64.

The smartphone 60 may have access to positioning systems such as GPS. When the GPS feature is enabled, the software application, upon the padlock 10 being locked, may note the position of the smartphone 60 (which will typically be relatively close to the keyless padlock 10) using the positioning system of the smartphone 60 and store the location in the memory 602 of the smartphone 60 or the software application. This will allow a user to locate the keyless padlock 10 which has been paired to the smartphone 60 if the user later forgets where the padlock 10 is located.

Figure 9:
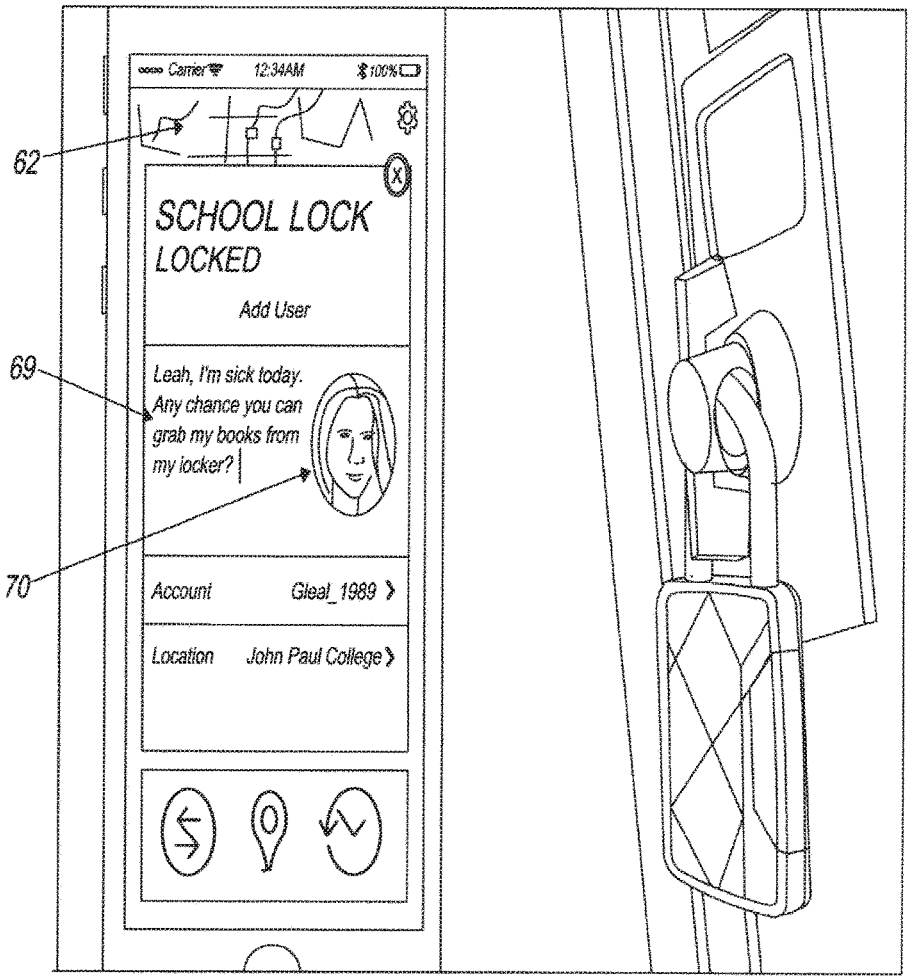
FIG. 9 is a schematic illustration of an interface generated on the smartphone of a third party by the software application upon receipt of authorisation to unlock a keyless padlock belonging to an owner.

Padlock 10 location information may also be forwarded to a third party if the authorised owner of the padlock 10 wishes that the third party be able operate the lock, as illustrated in FIG. 9. Typically, this information will be capable of display on the interface of the third party's smartphone 300 (FIG. 10) having at least its own processor 301, memory 302, Bluetooth module 304, and internet access interface 306.

Authorisation may be provided to the third party by the padlock 10 owner permanently, until revoked, for a specified period of time, or on a single use basis. For example, the owner of the padlock 10 can authorise third parties using the software application on the owner's smartphone 60 in association with the contacts list of the smartphone 60. The interface on the smartphone 60 of the owner may therefore also include identification, typically photos 65 of the third parties that can be authorised to unlock the padlock 10 on the owner's behalf as illustrated in FIG. 7.

Figure 8:
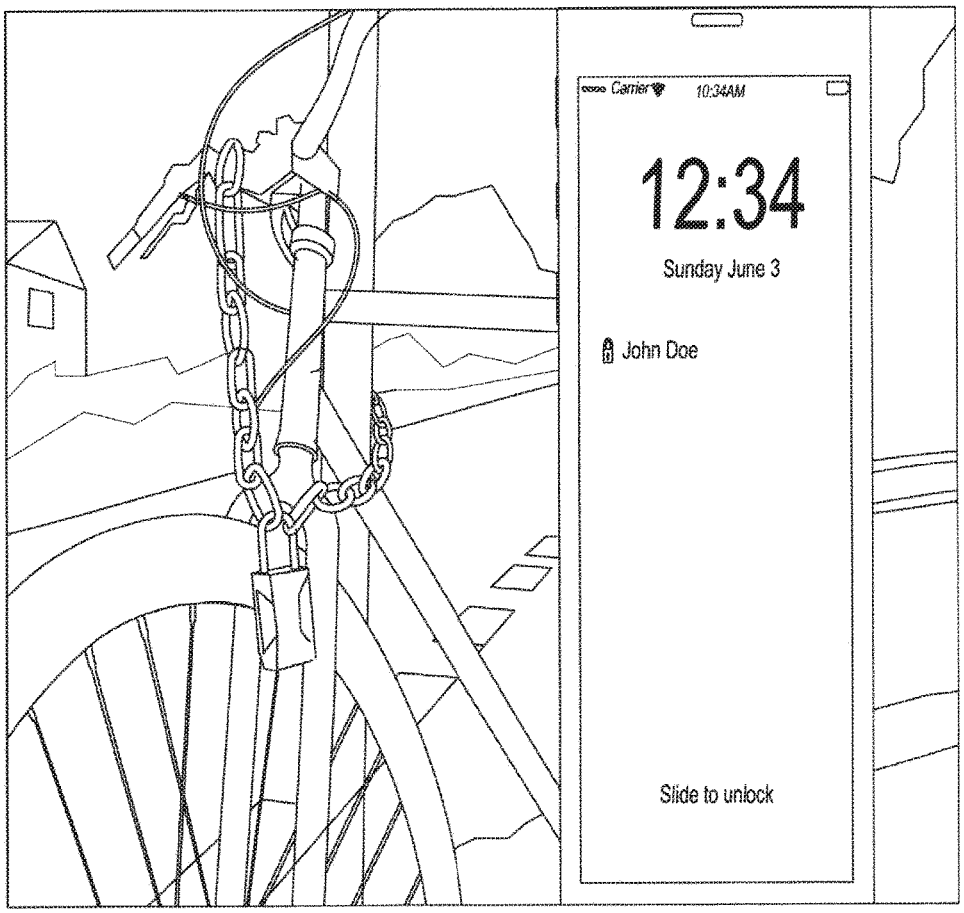
FIG. 8 is a schematic illustration of a message interface generated on the smartphone of a third party by the software application upon receipt of authorisation to unlock a keyless padlock belonging to an owner.
Figure 12A:
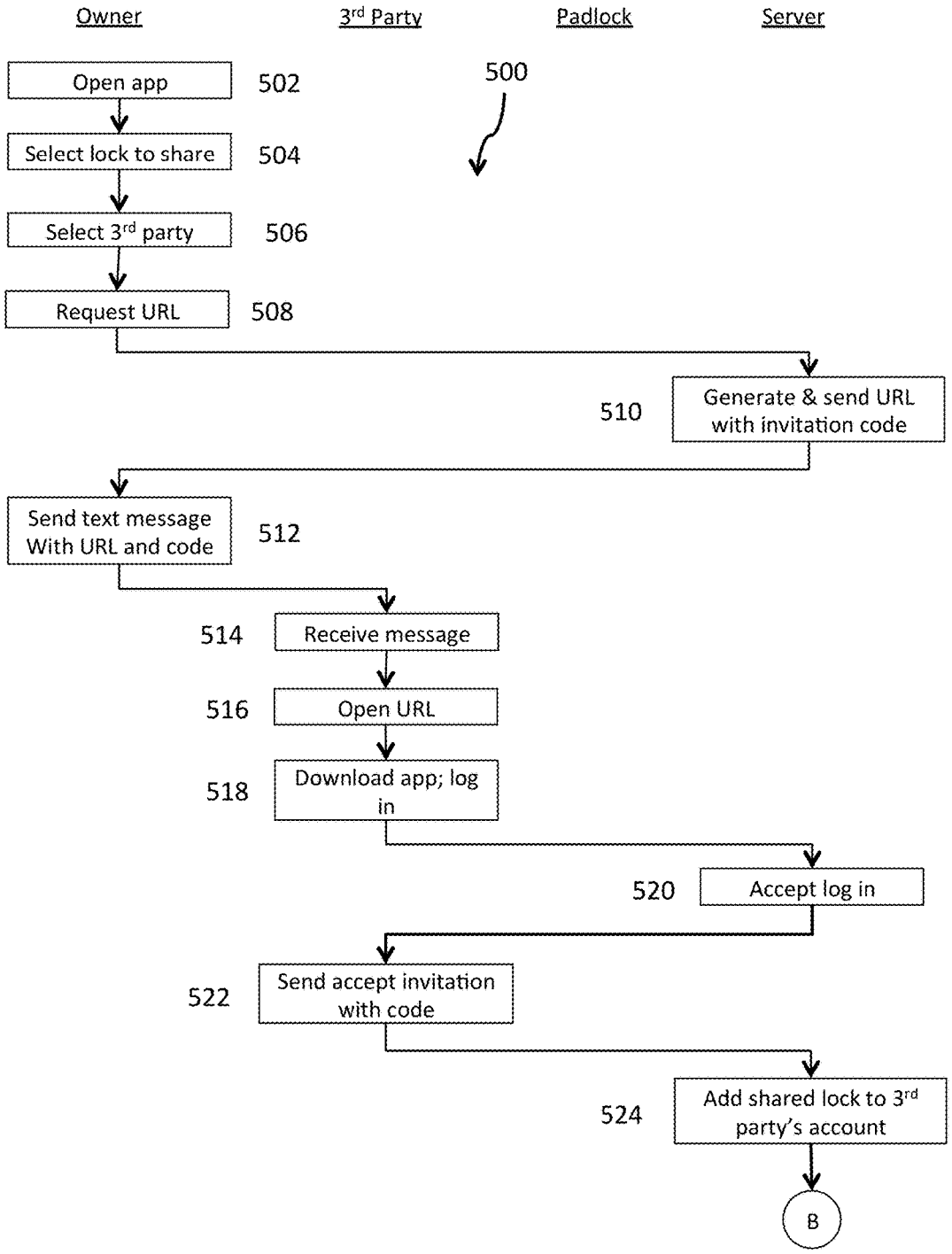
FIG. 12A is a flowchart of a method of authorizing third party use of the keyless padlock of FIG. 10.
Figure 12B:
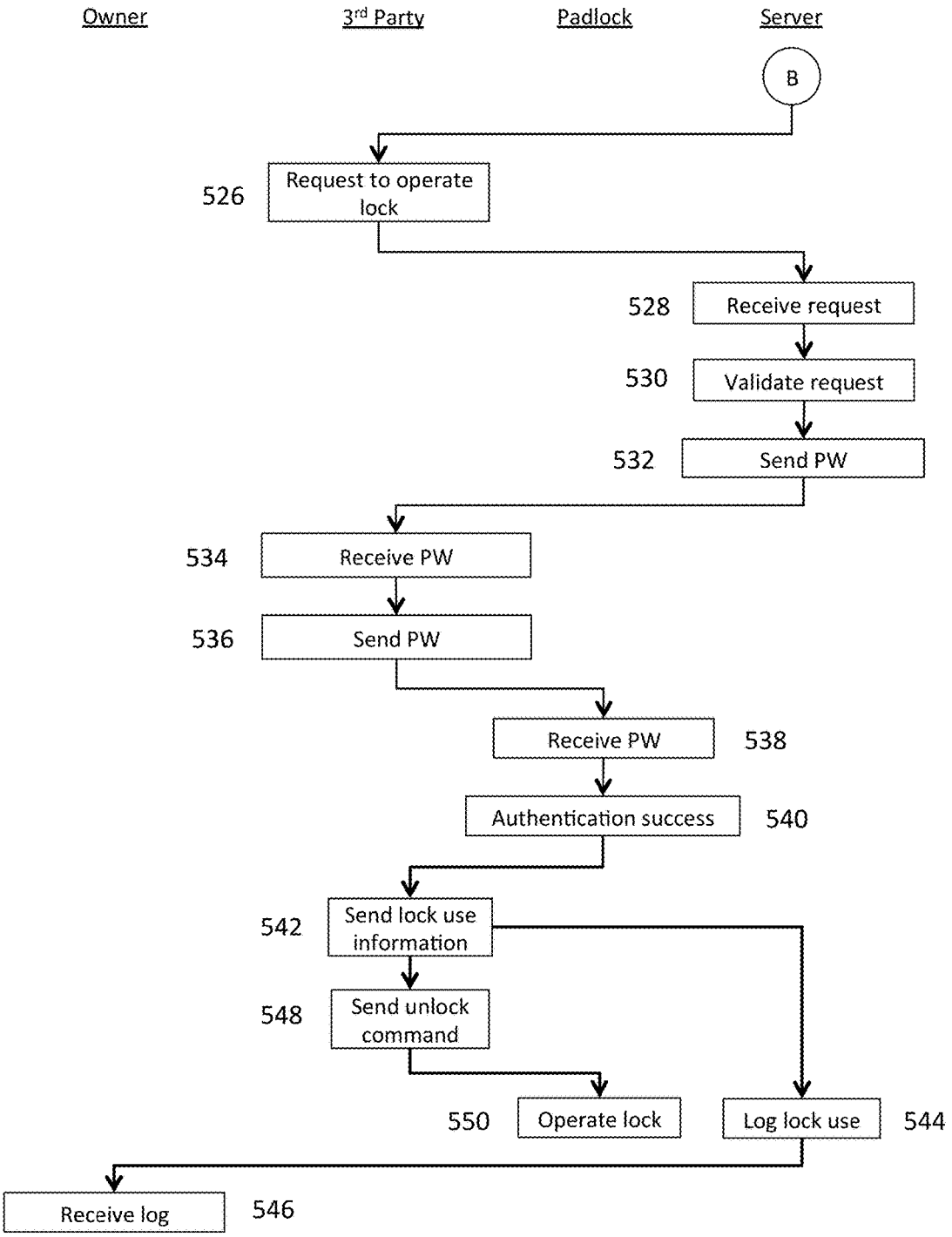
FIG. 12B is a continuation of the flowchart of FIG. 12A.

The interface includes an action (lock/unlock) icon 66, and a pin icon 67 to save the location of the padlock 10 in the memory of the smartphone 60. There is also an icon 68 provided to authorise third parties. The process 500 for authorizing third parties to use the lock 10 is illustrated in the flowchart of FIGS. 12A and 12B. To begin, the owner of the lock 10 opens the app on the smartphone 60 (step 502) and selects the lock 10 that the owner wishes to share (step 502) as well as the third party (step 504) with who the lock 10 is to be shared. The app then sends a request over the internet to the server 200 (step 508). The server 200 responds by generating a URL with an invitation code and sending the URL and code back to the app (step 510). After receiving the URL and invitation code, the app, either automatically or by a later action by the owner of the lock 10, sends a text message to the third party that contains both the URL and the invitation code (step 512). An example of such a message is shown in FIG. 8.

After the third party receives the text message on his or her smartphone 300 (step 512), the third party uses the internet capability 306 of the smartphone 300 to open the URL link with the server 200. If the third party hasn't done so already, the third party downloads the software application from the server 200 and establish an account. After the account is established, or if the app was already installed on the smartphone 300, the third party may log in to the server 200 (step 518). The server 200 accepts the log in and requests that the third party accept the invitation (step 520). The app then accepts the invitation and sends the code to the server 200 (step 522), either automatically upon successful log in or upon an action by the third party. Once the invitation has been accepted, the server 200 adds the shared lock 10 to the third party's account (step 524). The app may provide a display such as that shown in FIG. 9

When the third party wishes to operate the lock 10, the third party uses the app to send a request via the internet to the server 200 (step 526). After receiving the request (step 528), validating the request against information in the database 208 (step 530), and obtaining the password associated with the lock 10, the server 200 sends the password to the third party (532). The third party receives the password (step 534) and, using Bluetooth pairing, uses the app on the smartphone 300 to send the password to the lock 10 (step 536). Upon receipt of the password (step 538), the lock 10 determines if the password is correct. If so, the lock 10 authenticates the password (step 540), provides the app with the status of the lock 10 (FIG. 7), and optionally provides the location of the lock 10. If the password is not authenticated, the third party's attempt to operate the lock 10 is rejected. Whether the password is authenticated or not, the attempt is logged by the lock 10 and sent through the third party's smartphone 300 (step 542) to the server 200 where it is stored in the appropriate account in the database 208 (step 544) and sent to the owner's smartphone 60 (step 546). Confirmation that the password sent by the third party was authenticated is also sent to the app on the third party's smartphone 300 which may then send a command to the lock 10 to operate the lock 10 (step 548), which receives and executes the command (step 550).

If the owner wishes to transfer the keyless padlock 10 to another person, an internet connection is established between the lock 10 and the server 200. The lock 10 is selected in the app and the owner is presented with, among other options, an option to delete the lock 10. After the delete option is selected and confirmed, the database 208 on the server 200 is updated and the lock 10 becomes "unowned." A new prospective owner may then proceed through the initialization process (FIGS. 11A, 11B) to become the new owner.

If the owner's smartphone 60 becomes lost, the owner may use a different device, such as another smartphone, to download the app and log in his or her account on the server 200 using the account user name and password. Because the lock 10 may only be logged in on one device at a time, the smartphone 60 will automatically be logged out of the account, thus disabling its ability to operate the lock 10. If the smartphone is turned off, in the airplane mode, or otherwise has no internet connection, the owner may instead reset the lock 10 by deleting it from a list of available locks and then proceed through the initialization process to re-won the lock on the new device.

Figure 13:
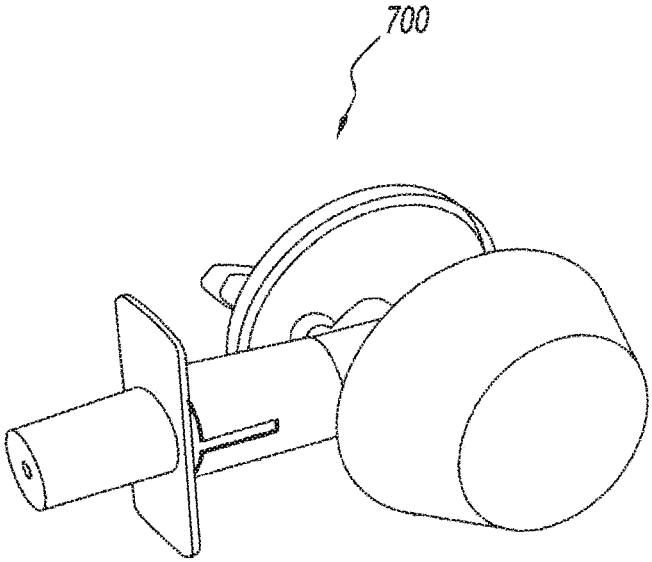
FIG. 13 illustrates another embodiment of a keyless lock of the present invention.

FIG. 13A is a flowchart of another method 600 of initializing the keyless padlock of FIG. 10. The owner of the smartphone 60 opens the app (step 602) and the app searches for padlocks in the immediate area (step 604). The owner selects the desired unowned lock 10 (step 606) and the app begins the Bluetooth pairing process (step 608). After the padlock 10 accepts the pairing (step 610), the user may then operate the padlock 10 using the app.

FIG. 13B is a flowchart of a method of operating the keyless padlock initialized using the method of FIG. 13A. With the app open (step 612), the app searches for padlocks in the immediate area (step 614) and the owner selects the desired owned (paired) padlock 10 (step 616), making the Bluetooth connection with the padlock 10 (step 618). The user may then use the app to operate the lock (step 620) and the padlock 10 responds to the commands by opening or closing (step 622) after which the app receives confirmation that the lock has been successfully operated (step 624).

Although much of the description and figures refer to keyless padlocks, the present invention may also be incorporated in any other type of lock, such as a keyless deadbolt 700 illustrated in FIG. 14.

In the present specification and claims (if any), the word 'comprising' and its derivatives including 'comprises' and 'comprise' include each of the stated items but does not exclude one or more further items.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art. Furthermore, it will be appreciated that the software application and other processes of the present invention are capable of being stored in the form of a processor-readable medium of instructions and that the present invention applies regardless of the particular type of media actually used to store the instructions. Such media includes non-transitory media such as, for example, RAM and ROM.

The invention claimed is:

1. A keyless padlock system, comprising:

a keyless padlock comprising:

a padlock body;

a shackle;

a locking mechanism located in the body and associated with the shackle to lock the shackle to the body in a locked condition and to release at least a part of the shackle in an unlocked condition, the locking mechanism comprising:

a control assembly, comprising:

a memory in which a padlock serial number and an initial password are stored; and a communication module; and an actuator controlled by the control assembly to move the shackle into the locked condition and into the unlocked condition in response to respective signals from the control assembly; and an application loadable on a personal computing device of a user, the personal computing device having a memory, a processor, and a communication module, the application comprising instructions executable by the processor to:

establish communication with the padlock;

request the padlock serial number from the padlock;

receive the padlock serial number from the padlock;

establish communication with a server having the padlock serial number and the initial password stored in a database;

transmit the padlock serial number to the server with a request to own the padlock;

receive the initial password and a new password from the server after the server has validated the request;

transmit the initial password to the padlock;

transmit the new password to the padlock after the padlock has validated the initial password;

receive confirmation from the padlock that the padlock has stored the new password in the memory of the padlock; and transmit the confirmation to the server, whereupon the server updates the database to recognize the user as the owner of the padlock.

2. The keyless padlock system of claim 1, wherein:

the communication modules of the padlock and of the personal computing device comprise Bluetooth modules; and the instruction to establish communication with the padlock comprises an instruction to establish a Bluetooth communication with the padlock.

3. The keyless padlock system of claim 1, wherein the instruction to establish a communication with the server comprises an instruction to establish an internet communication with the server.

4. The keyless padlock system of claim 1, wherein the application further comprises instructions executable by the processor to:

reestablish the connection with the padlock; and in response to an input from the user, transmit the new password to the padlock with a request move the shackle to one of the locked condition and unlocked condition.

5. The keyless padlock system of claim 1, wherein the application further comprises instructions executable by the processor to:

reestablish the communication with the server;

in response to an input from the user, transmit a request to the server to update the database by deleting the user as the owner of the padlock.

6. The keyless padlock system of claim 1, wherein the application further comprises instructions executable by the processor to:

receive a selection from the owner of the padlock that a third party be authorized to operate the padlock;

reestablish the communication with the server;

transmit a request to the server for a URL and an invitation code;

upon receipt of the URL and invitation code, transmit a message to a personal electronic device of a selected third party, whereupon the personal electronic device of the third party opens the URL and transmits the invitation code to the server after which the database is updated with the third party as an authorized user of the padlock; and receive log information from the server whenever the third party operates or attempts to operate the padlock.

7. The keyless padlock system of claim 6, wherein the instruction to transmit the request to the server for a URL and an invitation code further includes a request that the third party be authorized to operate the padlock for a selected one of permanently, until authorization is revoked by the owner, for a specified period of time, or one time.

8. A method of operating a keyless lock, comprising:

establishing a user of a personal electronic device as the authorized owner of the lock by:

establishing communication with the lock;

requesting the lock serial number from the lock;

receiving the lock serial number form the lock;

establishing communication with a server having the lock serial number and an initial password stored in a database;

transmitting the lock serial number to the server with a request to own the lock;

receiving the initial password and a new password from the server after the server has validated the request;

transmitting the initial password to the lock;

transmitting the new password to the lock after the lock has validated the initial password:

receiving confirmation from the padlock that the lock has stored the new password in a memory of the lock; and transmitting the confirmation to the server, whereupon the server updates a database to recognize the user as the owner of the lock; and allowing the authorized owner of the padlock to operate the lock by:

reestablishing the connection with the lock; and in response to an input from the authorized owner, transmitting the new password to the lock with a request move the lock to one of a locked condition and an unlocked condition.

9. The method of claim 8, wherein establishing communication with the lock comprises establishing a Bluetooth communication with the lock.

10. The method of claim 8, wherein establishing a communication with the server comprises establishing an internet communication with the server.

11. The method of claim 8, further comprising:

reestablishing the communication with the server;

in response to an input from the user, transmitting a request to the server to update the database by deleting the authorized owner as the owner of the lock.

12. The method of claim 8, further comprising:

receiving an input from the owner of the lock that a selected third party be authorized to operate the lock;

reestablishing the communication with the server;

transmitting a request to the server for a URL and an invitation code;

upon receipt of the URL and invitation code from the server, transmitting a message to a personal electronic device of a selected third party, whereupon the personal electronic device of the third party opens the URL and transmits the invitation code to the server after which the database is updated with the third party as an authorized user of the lock; and receiving log information from the server whenever the third party operates or attempts to operate the lock.

13. A non-transitory processor-readable medium comprising program instructions for operating a keyless lock, wherein the program instructions are executable by a processor on a personal computing device to:

establish communication with the lock;

request the lock serial number from the lock;

receive the lock serial number from the lock;

establish communication with a server having the lock serial number and an initial password stored in a database;

transmit the lock serial number to the server with a request to own the lock;

receive the initial password and a new password from the server after the server has validated the request;

transmit the initial password to the lock;

transmit the new password to the lock after the lock has validated the initial password;

receive confirmation from the lock that the lock has stored the new password in a memory of the lock; and transmit the confirmation to the server, whereupon the server updates a database to recognize the user as the owner of the lock.

14. The non-transitory processor-readable medium of claim 13, wherein the instruction to establish communication with the lock comprises an instruction to establish a Bluetooth communication with the lock.

15. The non-transitory processor-readable medium of claim 13, wherein the instruction to establish a communication with the server comprises an instruction to establish an internet communication with the server.

16. The non-transitory processor-readable medium of claim 13, wherein the program instructions are further executable to:

reestablish the connection with the lock; and in response to an input from the user, transmit the new password to the lock with a request move the lock to one of the locked condition and unlocked condition.

17. The non-transitory processor-readable medium of claim 13, wherein the program instructions are further executable to:

reestablish the communication with the server;

in response to an input from the user, transmit a request to the server to update the database by deleting the user as the owner of the lock.

18. The non-transitory processor-readable medium claim 13, wherein the program instructions are further executable to:

receive a selection from the owner of the lock that a third party be authorized to operate the lock;

reestablish the communication with the server;

transmit a request to the server for a URL and an invitation code;

upon receipt of the URL and invitation code, transmit a message to a personal electronic device of a selected third party, whereupon the personal electronic device of the third party opens the URL and transmits the invitation code to the server after which the database is updated with the third party as an authorized user of the lock; and receive log information from the server whenever the third party operates or attempts to operate the lock.

19. The non-transitory processor-readable medium of claim 18, wherein the instruction to transmit the request to the server for a URL and an invitation code further includes a request that the third party be authorized to operate the lock for a selected one of permanently, until authorization is revoked by the owner, for a specified period of time, or one time.

20. A keyless lock, comprising:

a locking mechanism located in a lock body to place the lock in a locked condition and in an unlocked condition, the locking mechanism comprising:

a control assembly comprising:

a Bluetooth communication module, the Bluetooth communication module configured to:

receive and accept a Bluetooth pairing request from a personal computing device of a user; and receive commands from the personal computing device to operate the lock;

a processor; and a memory configured to store a lock serial number, an initial password, and instructions executable by the processor for:

establishing communication with the personal computing device;

receiving a request from the personal computing device for the lock serial number;

transmitting the lock serial number to the personal computing device;

receiving the initial password from the smartphone;

transmitting validation of the initial password to the smartphone;

receiving a new password from the personal computing device; and storing the new password in the memory; and an actuator controlled by the control assembly to move the locking mechanism into the locked condition and into the unlocked condition in response to the received commands from the personal computing device.

21. The keyless lock of claim 20, wherein the instructions stored in the memory further comprise instructions for, after the new password has been stored in the memory and after the Bluetooth module has received a command from the personal computing device:

determine if the new password accompanies the command; and instruct the control assembly to enable the actuator to move the locking mechanism according to the command.

22. The keyless lock of claim 20, wherein the keyless lock comprises a keyless padlock.

23. The keyless lock of claim 20, wherein the keyless lock comprises a keyless deadbolt.

24. The method of claim 8, wherein the keyless lock is a keyless padlock.

25. The method of claim 8, wherein the keyless lock is a keyless deadbolt.

26. The non-transitory processor-readable medium of claim 13, wherein the keyless lock is a keyless padlock.

27. The non-transitory processor-readable medium of claim 13, wherein the keyless lock is a keyless deadbolt.

* * * * *